US010059540B2

(12) United States Patent
Tateishi

(10) Patent No.: US 10,059,540 B2
(45) Date of Patent: Aug. 28, 2018

(54) SHEET FEEDING APPARATUS AND IMAGE FORMING APPARATUS

(71) Applicant: CANON KABUSHIKI KAISHA, Tokyo (JP)

(72) Inventor: Satohisa Tateishi, Abiko (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/224,956

(22) Filed: Aug. 1, 2016

(65) Prior Publication Data

US 2017/0050811 A1 Feb. 23, 2017

(30) Foreign Application Priority Data

Aug. 21, 2015 (JP) ..... 2015-163454

(51) Int. Cl.
*B65H 1/04* (2006.01)
*G03G 15/00* (2006.01)

(52) U.S. Cl.
CPC ..... *B65H 1/04* (2013.01); *B65H 2405/324* (2013.01); *B65H 2407/21* (2013.01);
(Continued)

(58) Field of Classification Search
CPC ..... B65H 2407/21; G03G 15/6514
(Continued)

(56) References Cited

U.S. PATENT DOCUMENTS 3,599,971 A * 8/1971 Morioka ..... G03B 27/586 271/117
6,595,514 B2 * 7/2003 Takahashi ..... B65H 1/04 271/162
(Continued)

FOREIGN PATENT DOCUMENTS

JP 2002070409 A 3/2002
JP 2002193497 A 7/2002
(Continued)

OTHER PUBLICATIONS

Japanese Office Action issued in corresponding Japanese Application No. 2015-163454 dated Oct. 3, 2017.
(Continued)

*Primary Examiner* — Jeremy R Severson
(74) *Attorney, Agent, or Firm* — Fitzpatrick, Cella, Harper & Scinto

(57) ABSTRACT

A sheet feeding apparatus includes a tray swingably supported by an apparatus body through a link. A link support portion disposed in the apparatus body is engaged with a first end portion of the link. The link support portion includes first and second support parts respectively corresponding to first and second positions of the tray. The link support portion further includes a guide part along which the first end portion of the link moves between the first and second support parts. The guide part has a bent part between the first and second support parts so that a guiding direction in which the first end portion is guided from the first support part toward the bent part differs from a load direction in which the first end portion of the link applies load on the first support part in a case where the tray is positioned at the first position.

22 Claims, 8 Drawing Sheets

(52) U.S. Cl.
CPC .. *B65H 2601/321* (2013.01); *B65H 2601/324* (2013.01); *G03G 15/6514* (2013.01)

(58) Field of Classification Search
USPC ..... 271/9.09; 399/392
See application file for complete search history.

(56) References Cited

U.S. PATENT DOCUMENTS 7,444,112 B2 * 10/2008 Murakami ..... B41J 13/103 271/9.09
7,540,676 B2 * 6/2009 Ogawa ..... B41J 13/103 399/392
7,748,697 B2 7/2010 Fujita et al.
8,690,147 B2 * 4/2014 Okuchi ..... B65H 1/04 271/162
8,857,812 B2 * 10/2014 Yamamoto ..... B65H 1/04 271/162
9,188,928 B2 * 11/2015 Lee ..... G03G 21/1633
9,272,861 B2 3/2016 Tateishi et al.
9,272,862 B2 3/2016 Tateishi
9,604,806 B2 * 3/2017 Okura ..... B65H 5/26
2006/0182485 A1 * 8/2006 Ogawa ..... B41J 13/103 400/647
2006/0291342 A1 * 12/2006 Kang ..... B65H 1/04 369/30.78
2009/0267283 A1 * 10/2009 Mizuguchi ..... B65H 1/04 271/3.14
2014/0186083 A1 * 7/2014 Lee ..... G03G 21/1633 399/392
2016/0122140 A1 * 5/2016 Furusawa ..... B65H 1/04 271/147
2016/0332832 A1 * 11/2016 Okura ..... B65H 5/26

FOREIGN PATENT DOCUMENTS

JP 2007022791 A 2/2007
JP 2009057175 A 3/2009
JP 2009-096598 A 5/2009

OTHER PUBLICATIONS

Japanese Office Action issued in corresponding Japanese Application No. 2015-163454 dated May 23, 2017.

* cited by examiner

SHEET FEEDING APPARATUS AND IMAGE FORMING APPARATUS

BACKGROUND OF THE INVENTION

Field of the Invention

The present invention relates to a sheet feeding apparatus for feeding a sheet supported on a tray to a position that differs from the tray, and an image forming apparatus adopting the sheet feeding apparatus.

Description of the Related Art

Various types of electro-photographic or ink-jet image forming apparatuses are known. In these types of apparatuses, there are demands to perform maintenance operations without interrupting print jobs, with the aim to improve productivity.

An exemplary image forming apparatus accepts sheets formed of paper, plastic, and other materials as recording materials, and includes a sheet feeding apparatus to feed the sheets of such recording materials to the image forming apparatus. This type of sheet feeding apparatus may include a detachable cassette storing a large number of sheets, and a manual sheet feeding apparatus where sheets are mainly manually supplied from outside of the apparatus body.

The sheet feeding apparatus for manual sheet feeding includes a tray supported on the apparatus body and capable of being opened and closed. The tray can support one sheet or a plurality of sheets to be set manually. The sheet supported on the tray can be fed to an image forming mechanism provided inside the apparatus by a conveyance mechanism including a pickup roller arranged to face the tray, a conveyance roller, and a separation roller.

The tray is opened with respect to the apparatus body or a cover member by a swing mechanism, for example, and moved to a sheet feed position where the above-described manual sheet feeding is performed. Further, the tray is closed to a storage position by the same swing mechanism when the tray is not used, so that a surface of the tray forms approximately a same plane as the surface of the apparatus body or the cover member.

As regard the sheet feeding apparatus for manual sheet feeding arranged as above, there is a case where maintenance operation of the sheet conveyance mechanism including the pickup roller, the conveyance roller and the separation roller is required. There are demands for an arrangement where maintenance operations such as roller replacement can be performed easily, for example from an upper side of the tray supporting the sheet, without opening a door on the apparatus body or removing a number of other components.

However, an opening angle of the tray in a sheet feed position where the tray is at an opened state is often set to such an angle where the supported sheet is inclined downward toward the sheet conveyance mechanism composed of various rollers, in order to realize smooth feeding of sheets. Since the tray is opened at such a relatively small angle that is inclined downward toward the sheet conveyance mechanism, it has been difficult to ensure sufficient work space for roller replacement and the like.

It may be conceivable to adopt a method enabling maintenance operations such as roller replacement to be performed from the tray side by removing the tray of the sheet feeding apparatus or by changing the angle of the tray to expand the work space at the time of maintenance, without opening the apparatus body door. For example, a configuration of removing links and stoppers of a tray angle retention member may be considered as a method for changing the tray angle. Meanwhile, U.S. Pat. No. 8,857,812 discloses such a configuration using an elastic member that can be adopted for changing the opening angle of the tray in multiple steps.

However, the configuration taught in the above document requires continuous application of external force toward the swinging direction of the tray to change the angle of the tray from a position where sheets are fed to a position where maintenance is performed. Therefore, the tray angle may be changed by the weight of the sheets supported on the tray or unintentional touching of the tray by a user, and problems such as sheet feed failure and multiple sheet feed may occur. Further, if a method of removing the tray angle retention member is adopted, the removing operation may require tools, or the removed components may be lost, which cases lead to deterioration of maintenance performance.

SUMMARY OF THE INVENTION

A sheet feeding apparatus according to one aspect of the present invention includes an apparatus body, a tray swingably supported on the apparatus body, a sheet feed unit configured to feed a sheet supported on the tray, a link including a first end portion and a second end portion, the second end portion being configured to engage with the tray, and a link support portion disposed in the apparatus body and configured to engage with the first end portion of the link. The link support portion includes a first support part on which the first end portion is supported while the tray being positioned at a first position where the sheet supported on the tray is fed by the sheet feed unit, and a second support part on which the first end portion is supported while the tray being positioned at a second position where a swing angle of the tray is greater than the first position with respect to the apparatus body. The link support portion further includes a guide part along which the first end portion of the link moves between the first support part and the second support part, the guide part having a bent part between the first support part and the second support part so that a guiding direction in which the first end portion is guided from the first support part toward the bent part differs from a load direction in which the first end portion of the link applies load on the first support part in a case where the tray is positioned at the first position.

Further features of the present invention will become apparent from the following description of exemplary embodiments with reference to the attached drawings. The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Now, embodiments of the present disclosure will be described with reference to examples illustrated in the accompanying drawings. The embodiments illustrated below are merely examples, and those skilled in the art will be able to arbitrary change the detailed configuration without deviating from the scope of the present invention. The numerical values illustrated in the present embodiments are merely reference values, and they are not intended to restrict the present invention. The dimensions, shapes and materials of the components disclosed in the following description and the relative arrangements of the components should be varied arbitrarily according to the configuration of the apparatus to which the present invention is applied or based on various conditions, and they are not intended to limit the scope of the present invention to the illustrated examples. Specifically, any arbitrary material, such as metal or resin, can be used as the material of a body, a frame, a door, a cassette storing or supporting a sheet, or a tray of the image forming apparatus.

General Arrangement of Image Forming Apparatus

Figure 8:
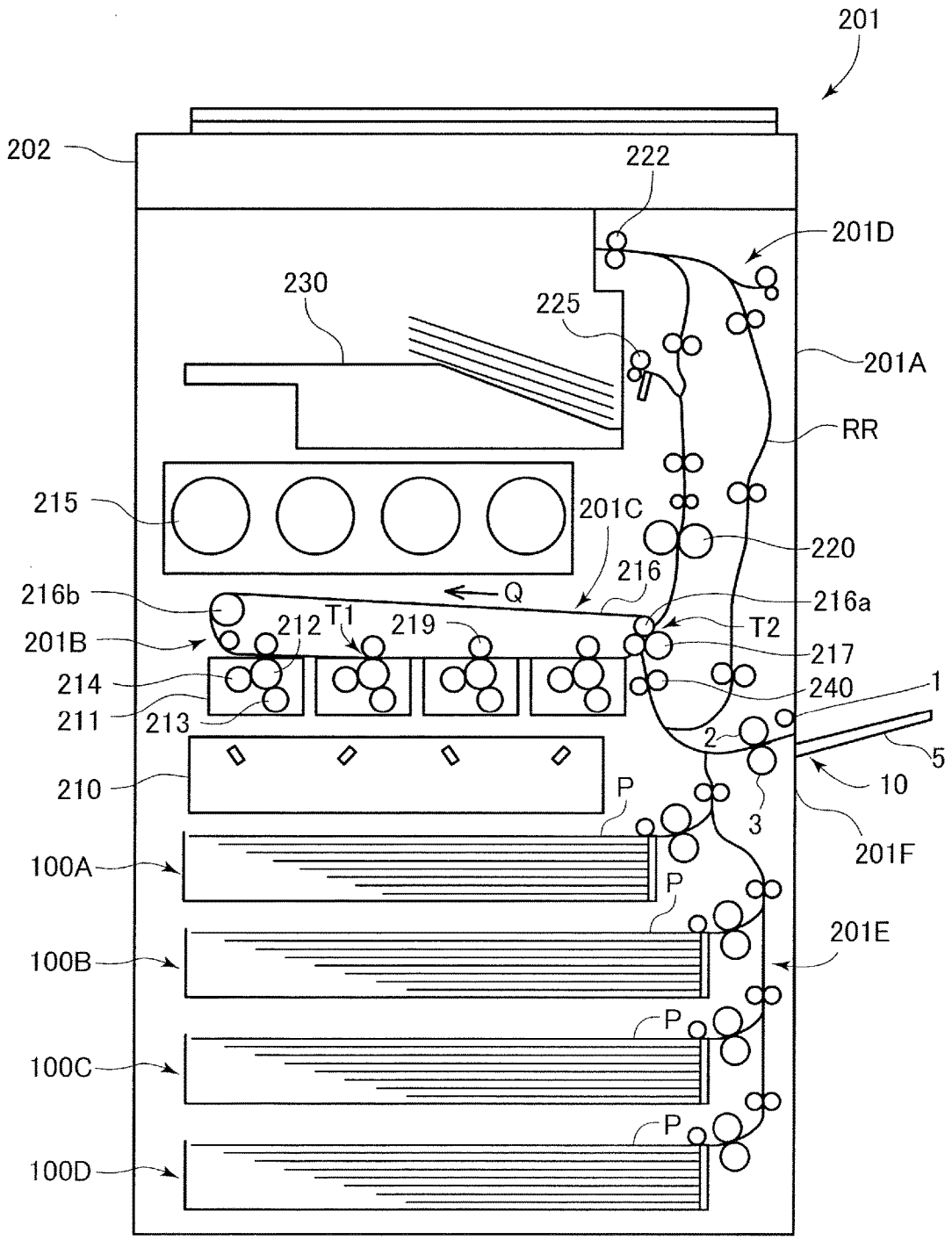
FIG. 8 is a schematic diagram of the sheet feeding apparatus according to the present embodiment and an image forming apparatus including the sheet feeding apparatus.

FIG. 8 illustrates one example of an arrangement of an image forming apparatus capable of implementing the arrangement of a sheet feeding apparatus according to the present embodiment. In the following description, a state in which an image forming apparatus 201 is seen from a front side, that is, the viewpoint of FIG. 8, is used as reference to describe positional relationships in vertical and horizontal directions.

The image forming apparatus 201 shown in FIG. 8 is a full-color electro-photographic image forming apparatus, such as a full-color laser beam printer. The image forming apparatus 201 includes, in an interior of an apparatus body 201A (printer body), i.e. the image forming apparatus body, an image forming unit 201B forming an image on a sheet P formed of paper, plastic material, or other materials, and a fixing unit 220 fixing an image on the sheet P.

An image reading apparatus 202 reading an image data of a document is arranged in an upper portion of the apparatus body 201A such that a supporting surface of the document is positioned approximately horizontally. A sheet discharge tray 230 is provided in a discharge space between the image reading apparatus 202 and the apparatus body 201A onto which the sheet P is discharged.

Further, a sheet feeding unit 201E feeding sheets P to the image forming unit 201B is provided in the apparatus body 201A. The sheet feeding unit 201E includes sheet feeding apparatuses 100A, 100B, 100C and 100D arranged at a lower portion of the apparatus body 201A, and a sheet feeding apparatus 10 for manual sheet feeding arranged at a right side of the apparatus body 201A.

The sheet feeding apparatuses 100A, 100B, 100C and 100D are stored in an inner side at a lower portion of the image forming apparatus 201, and they are respectively composed of cassettes capable of storing a large number of sheets. The respective cassettes of the sheet feeding apparatuses 100A, 100B, 100C and 100D are designed to be attached removably via a mechanism not shown for supplying sheets.

Further, a right door 201F, the detail of which is not shown, is arranged on a right side surface of the apparatus body 201A. In the present embodiment, a portion of the apparatus body 201A is composed of the right door 201F. A service technician or a user can access the area around the cassettes of the sheet feeding apparatuses 100A, 100B, 100C and 100D and sheet feed units such as a pickup roller or a conveyance roller, or other components of a sheet feed mechanism.

The sheet feeding apparatus 10 has a tray 5 on which sheets for manual feeding are set. The sheets (not shown) supported on the tray 5 are separated one by one and fed by a pickup roller 1 arranged to face the tray 5, a conveyance roller 2, and a separation roller 3, and the sheet is conveyed to a sheet feeding unit 201E arranged within the apparatus.

The tray 5 of the sheet feeding apparatus 10 is supported swingably by a swing support mechanism (and link mechanism) described later using a portion of the right door 201F constituting the right side portion of the apparatus body 201A.

The image forming unit 201B is a so-called four-drum full-color image forming unit having a laser scanner 210, four process cartridges 211, and an intermediate transfer unit 201C. These process cartridges 211 form toner images of respective colors, which are yellow (Y), magenta (M), cyan (C) and black (K). The process cartridges 211 of respective colors include a photosensitive drum 212, i.e., image bearing member, a charger 213, i.e., charging unit, a developer 214, i.e., image developing unit, and a cleaner, i.e., cleaning unit, not shown. Toner cartridges 215 storing toners of respective colors are attached removably to the apparatus body 201A above the image forming unit 201B.

Images of respective colors are superimposed and transferred, i.e., primarily transferred, from the process cartridges 211 of respective colors to an intermediate transfer unit 201C, and a full-color image is transferred to a sheet P via the intermediate transfer unit 201C. The intermediate transfer unit 201C includes an intermediate transfer belt 216, i.e., intermediate transfer body, wound around a drive roller 216*a* and a tension roller 216*b*, and is arranged above the four process cartridges 211. The intermediate transfer belt 216 is arranged to contact the photosensitive drums 212 of the respective process cartridges 211, and driven to rotate in a counterclockwise direction, i.e., direction of arrow Q, by the drive roller 216*a* that is driven by a drive unit not shown.

The intermediate transfer unit 201C has primary transfer rollers 219 that contact an inner circumferential surface of the intermediate transfer belt 216 at positions facing the respective photosensitive drums 212, and primary transfer portions T1 are formed as nip portions of the intermediate transfer belt 216 and the photosensitive drums 212. Further, the image forming unit 201B includes a secondary transfer roller 217 that contacts an outer circumferential surface of the intermediate transfer belt 216 at a position facing the drive roller 216*a*. A secondary transfer portion T2 where a toner image borne on the intermediate transfer belt 216 is transferred to the sheet P is formed as a nip portion between the secondary transfer roller 217 and the intermediate transfer belt 216.

In the respective process cartridges 211 arranged as described, an electrostatic latent image is drawn on the surface of the photosensitive drum 212 by the laser scanner 210, and toner is supplied from the developer 214 to form a color toner image charged with negative polarity. The respective toner images are sequentially transferred, i.e., primarily transferred, in multiple layers, to the intermediate transfer belt 216 at the respective primary transfer portions T1 by applying a transfer bias voltage of positive polarity to the primary transfer rollers 219, and a full-color toner image is formed on the intermediate transfer belt 216.

Simultaneously as the above-described toner image forming process, the sheet P fed from the sheet feeding unit 201E is conveyed toward a registration roller pair 240, where skewing of the sheet is corrected by the registration roller pair 240. The registration roller pair 240 conveys the sheet P to the secondary transfer portion T2 at a timing matching the transfer timing of the full-color toner image formed on the intermediate transfer belt 216. The toner image borne on the intermediate transfer belt 216 is secondarily transferred to the sheet P at the secondary transfer portion T2 by having a transfer bias voltage of positive polarity applied to the secondary transfer roller 217.

The sheet P to which the toner image has been transferred is heated and pressed by the fixing unit 220, and a color image is fixed onto the sheet P. When forming an image on only one side of the sheet P, i.e., single-side recording, the sheet P on which the image has been fixed is discharged via a discharge roller pair 225 onto the discharge tray 230 and stacked on the tray 230. When forming images on both sides of the sheet P, i.e., two-sided recording, the sheet P on which the image has been fixed on one side and having passed through the fixing unit 220 is moved in switch-back motion by a reverse conveyance roller pair 222 capable of forward/reverse rotation provided in a reverse conveyance unit 201D. Thereafter, the sheet P is conveyed again to the image forming unit 201B via a re-conveyance path RR, where an image is formed on the rear side of the sheet P.

Sheet Feeding Apparatus

Figure 1:
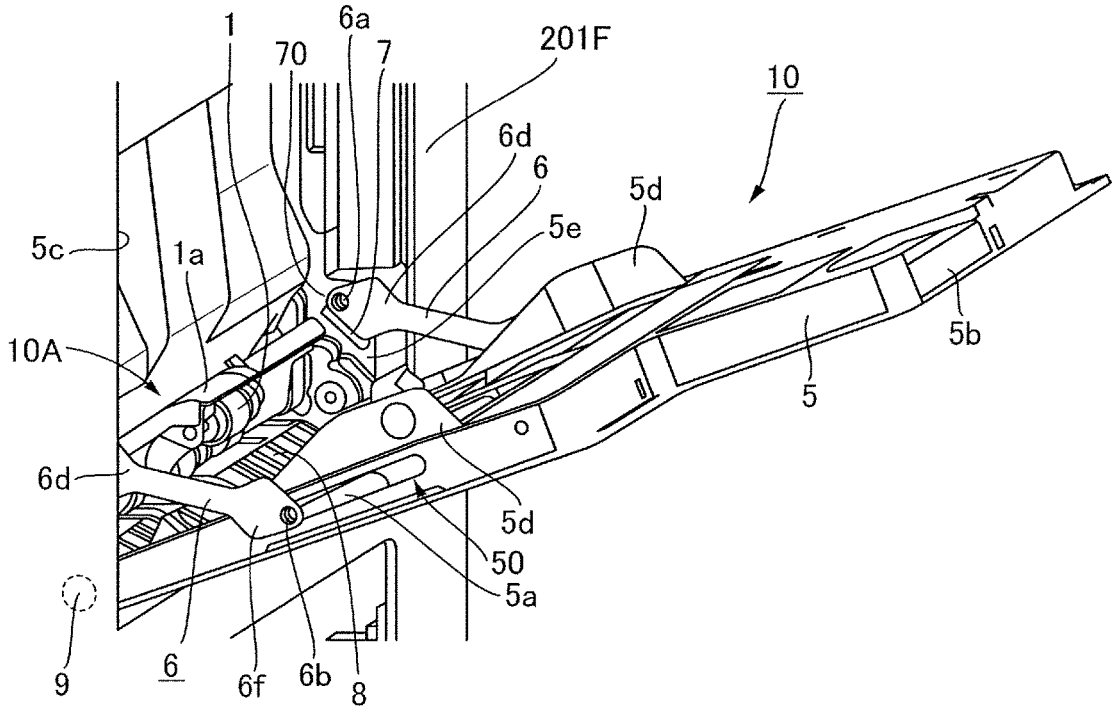
FIG. 1 is a perspective view of a sheet feeding apparatus according to the present embodiment, illustrating a state where a tray is positioned at a sheet feed position.

FIG. 1 illustrates a perspective view of the configuration of an area around the sheet feeding apparatus 10 for manual sheet feeding illustrated in FIG. 8. The sheet feeding apparatus 10 of FIG. 1 has a tray 5 for supporting the sheet to be fed manually. The tray 5 is supported swingably on a portion of the body of the image forming apparatus 201, such as a part of the right door 201F, via a swing shaft 9 (illustrated by dashed lines). In the following description, the tray 5 is disposed on the right door 201F constituting a portion of the body of the image forming apparatus 201, but the tray 5 is not necessarily disposed on the portion of the door, and can be disposed at any arbitrary position of the body of the image forming apparatus 201.

Figure 2:
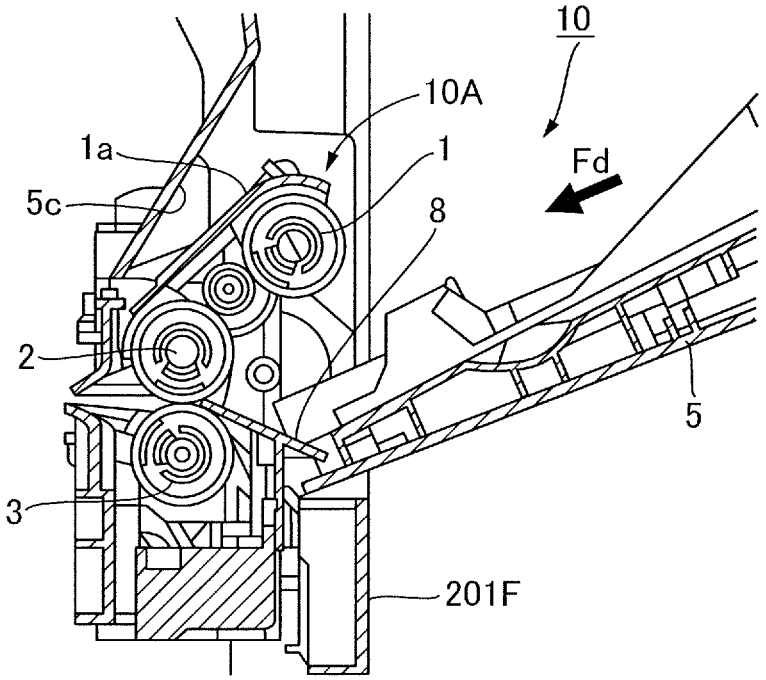
FIG. 2 is a cross-sectional view of a relevant portion of the sheet feeding apparatus, illustrating a state where the tray is positioned at the sheet feed position.
Figure 3A:
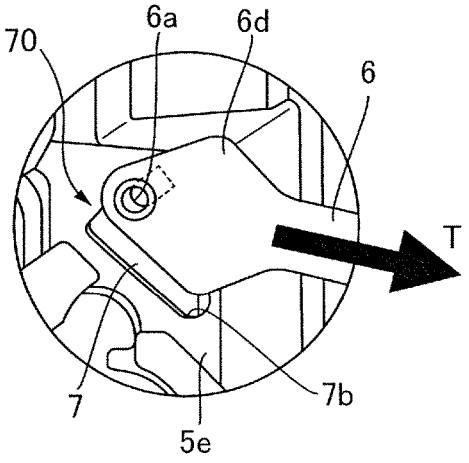
FIG. 3A is a perspective view of an engagement portion of a link and a link hole constituting a support structure of the sheet feeding apparatus.
Figure 3B:
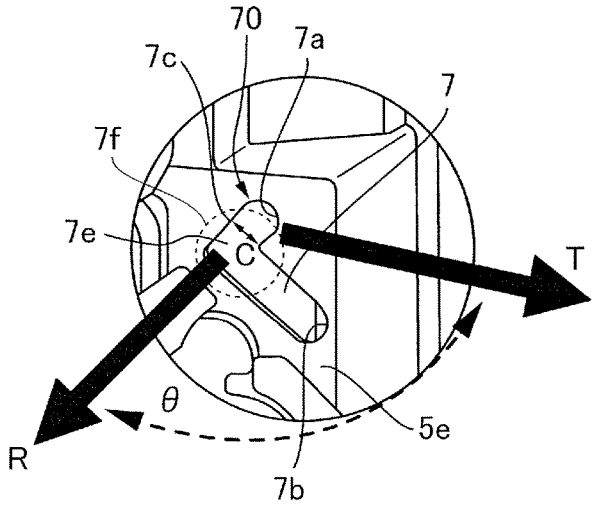
FIG. 3B is a perspective view of a shape of the link hole.

FIG. 1 illustrates a perspective view of the tray 5 in a swung state, positioned at a sheet feed position for performing manual sheet feeding of a sheet (not shown) supported on the upper surface of the tray 5. FIG. 2 is a cross-sectional view of an area around a swing mechanism of the tray 5 in the state illustrated in FIG. 1, and FIGS. 3A and 3B illustrate an enlarged view of a relevant portion of a link mechanism regulating a swing position or swing range of the tray 5.

Figure 4:
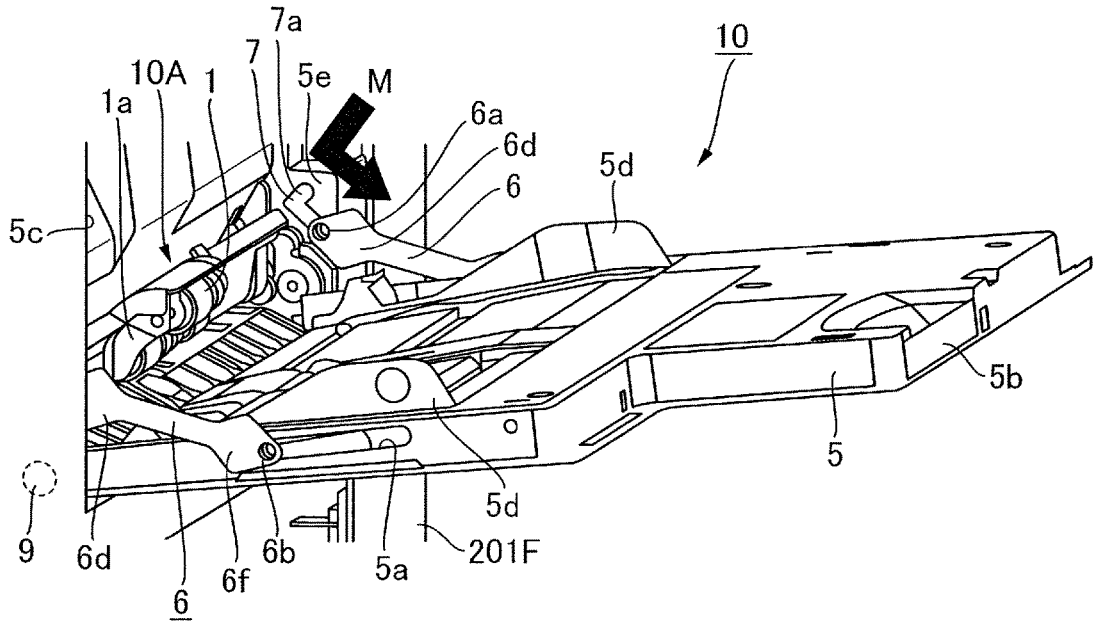
FIG. 4 is a perspective view of the sheet feeding apparatus, illustrating a state where the tray is positioned at a maintenance position.
Figure 5:
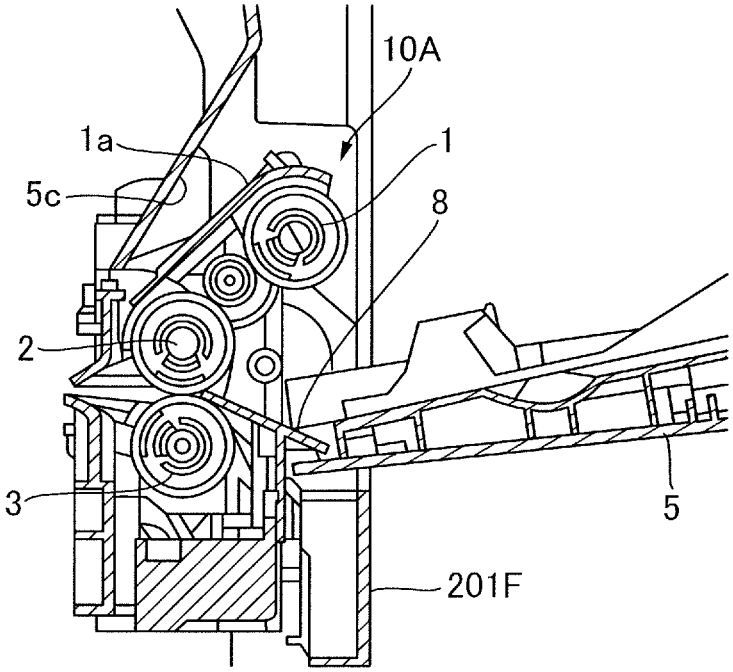
FIG. 5 is a cross-sectional view of a relevant portion of the sheet feeding apparatus, illustrating a state where the tray is positioned at the maintenance position.
Figure 6:
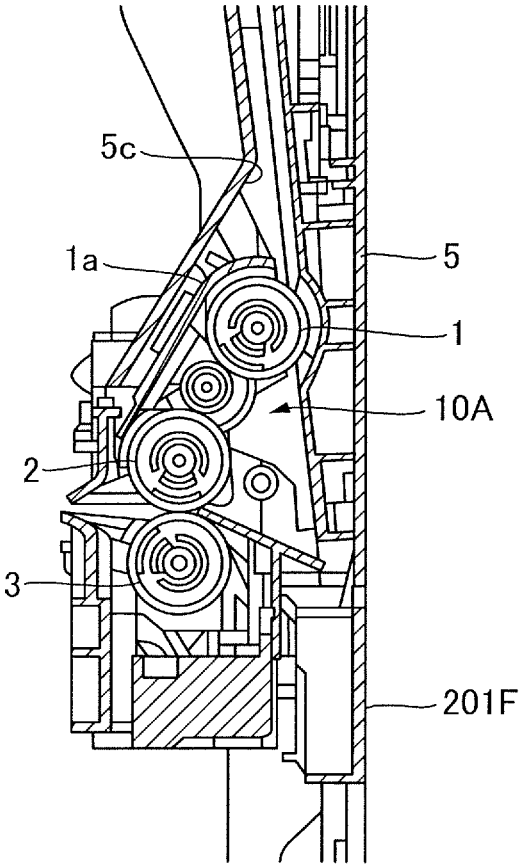
FIG. 6 is a cross-sectional view of a relevant portion of the sheet feeding apparatus, illustrating a state where the tray is positioned at a storage position.

In the sheet feeding apparatus 10 of the present embodiment, the tray 5 can be positioned at a (manual) sheet feed position, i.e., first position, illustrated in FIGS. 1 and 2 by a link mechanism described later. Further according to the present embodiment, the tray 5 can be moved in swinging motion to a maintenance position, i.e., second position, opened at a greater swing angle than the sheet feed position with respect to a perpendicular right door 201F by a link mechanism described later, as illustrated in FIGS. 4 and 5. The swing angle is an opening angle of the tray 5 with respect to the apparatus body 201A. According further to the present embodiment, the tray 5 can be moved to a storage position where a rear surface of the tray 5 is approximately flush with an exterior surface of the right door 201F. FIG. 4 is a perspective view adopting a similar form as FIG. 1, and FIGS. 5 and 6 are cross-sectional views adopting a similar form as FIG. 2.

Guide plates 5*d* and 5*d* regulating width-direction positions (corresponding to a front-back direction, or a perpendicular direction to the page, in FIGS. 1 and 2) of the supported sheets are provided on an upper surface of the tray 5 of the sheet feeding apparatus 10. The guide plates 5*d* and 5*d* are supported by a movable support mechanism (the details of which are not shown) provided on the tray 5, and designed so that the positions of the guide plates can be adjusted to correspond to the sheet width, such as A4 and B5, about a meddle part of the tray 5 as a reference.

Further, a sheet feed unit 10A including the pickup roller 1, the conveyance roller 2 and the separation roller 3 is arranged to face a lower edge, i.e., a downstream end in a sheet conveyance direction, of the tray 5. The pickup roller 1, the conveyance roller 2, and the separation roller 3 are driven by a drive mechanism not shown arranged in an interior of the apparatus body 201A. Thereby, the sheet supported on the tray 5 is separated and fed one by one, and conveyed to the sheet feeding unit 201E inside the apparatus.

The pickup roller 1 within the sheet feed unit 10F is supported by a pickup roller support portion 1*a*, as illustrated in FIGS. 1 and 2. The pickup roller 1 is lowered toward a sheet supported on the tray 5 by the pickup roller support portion 1*a*, for example, and sends out a sheet toward the left direction in the drawing. The picked up sheet is guided by a nip guide 8, i.e., guide member, toward a nip, i.e., abutment portion, between the conveyance roller 2 and the separation roller 3 arranged above a lower end of the tray 5, as illustrated in FIG. 2, and conveyed between the conveyance roller 2 and the separation roller 3.

End portions of both side edges of the tray 5 are supported swingably by the above-described swing shaft 9 (only a front side portion thereof illustrated by dashed lines) with respect to the right door 201F of the image forming apparatus 201. The swing shaft 9 constitutes a swing support mechanism of the tray 5.

Further, a link mechanism is provided to set the position or orientation of the tray 5 to the above-described sheet feed position, the maintenance position described later or the storage position. The link mechanism includes a link 6 composed of a metal, plastic plate member, or the like, as illustrated in FIG. 1, a guide hole 7 arranged on a side of the right door 201F and engaged with the link 6, and an engagement portion such as guide grooves 5*a* provided on both side edges of the tray 5.

The guide holes 7, 7 formed on the body are engaged with the links 6, 6. That is, a link support portion 70 (FIG. 3B) supporting the links 6, 6 is composed of a circumference portion of the guide hole 7. Further, the guide grooves 5*a*, 5*a* are engagement portions supporting the links 6, 6, and constitute a link support portion 50 (FIG. 1) on the tray 5.

In the present embodiment, the tray 5 is positioned at a swing angle corresponding to the sheet feed position described later or the maintenance position, based on the engagement and support of these link support portions (70, 50) of the link mechanism regulating the position and the orientation, of the tray 5. Specifically, the engagement and support of the link support portion 70 is performed rigidly at the respective positions of the sheet feed position (FIGS. 1 and 2) and the maintenance position (FIGS. 4 and 5) according to the present embodiment. That is, in the present embodiment, the link support portion is configured to hold the link at one of lock positions against the load without yielding, i.e., giving in, to the load, even when a load such as the weight of sheets or external force applied by the user or service engineer acts on the swinging direction of the tray at the respective positions including the sheet feed position and the maintenance position of the tray 5.

A storage concave portion 5*c* of a size corresponding to the tray 5 is formed on the right door 201F while forming a space to store the tray 5 at the storage position (FIG. 6). The guide holes 7, 7 bent in an L-shape (FIG. 3B) are arranged on inner wall surfaces 5*e*, 5*e* at both sides of the storage concave portion 5*c*.

As illustrated in FIG. 1, the links 6, 6 have first and second end portions 6*d* and 6*f*, and pins 6*a* and 6*b* are respectively arranged as engagement ends on the end portions 6*d* and 6*f*. The pins 6*a*, 6*a* on the links 6, 6 are respectively engaged with the guide holes 7, 7 provided on the inner wall surfaces 5*e*, 5*e* of the storage concave portion 5*c*. Pins 6*b* (back side pin not illustrated) are engaged with the guide grooves 5*a* on both side edges of the tray 5.

The pin 6*a* of the link 6 is hollow-shaped as illustrated by the dashed line in FIG. 3A, and is embedded to a first end portion 6*d* of the link 6. The pin 6*a* may be embedded by caulking or other structures to the first end portion 6*d* of the link 6, but it can also be formed integrally with the link formed of metal or resin. Further, the pin 6*a*, which is engaged with the L-shaped guide hole 7, may include a flange-shaped stopper portion (not shown) to be locked to the guide hole 7 on an end of the pin 6*a* if necessary, in order to prevent the pin from falling from the guide hole 7. A similar structure as the one described above can be adopted for the engagement structure between a pin 6*b* of a second end portion 6*f* of the link 6.

As illustrated in FIG. 3B, the guide hole 7 is formed to have a shape bent in an L-shape on inner wall surfaces 5*e*, 5*e* on both sides of the storage concave portion 5*c*. The guide hole 7 includes first and second lock holes 7*a* and 7*b*, i.e., first and second support parts for the link 6, and a guide groove 7*e*, i.e., guide part. The guide groove 7*e* is formed into an L-shaped opening, or a hole, communicating the lock holes 7*a* and 7*b*. In other words, the guide part according to the present embodiment is shaped so that the section from the first support part to the bent portion and the section from the bent portion to the second support part are respectively formed to be approximately linear.

Lock holes 7*a* and 7*b* of the guide hole 7 constitute first and second support parts locking the tray 5 at different lock positions against the load applied in the swinging direction of the tray 5 via the pin 6*a* of the first end portion 6*b* of the link 6. According to this arrangement, even when a load such as the weight of the sheets or the operating force of the user or the service engineer is applied in the swinging direction of the tray 5 at the respective positions such as the sheet feed position or the maintenance position of the tray 5, the lock holes 7*a* and 7*b* hold the link 6 at the respective lock positions against the load, without yielding to the load. Especially, this rigid supporting function becomes more certain by taking the following into consideration in addition to the shapes and dimensions of various components of the guide hole 7.

The pins 6*a*, 6*a* on the first end portion 6*d* of the links 6, 6 can be moved between the first and second lock holes 7*a* and 7*b* of the guide holes 7, 7. It is designed to select one of two lock positions so that the pin 6*a* is locked to the lock hole 7*a*, i.e. first support part, or to the lock hole 7*b*, i.e. second support part. The first and second lock positions respectively correspond to the sheet feed position (FIGS. 1 and 2) and the maintenance position (FIGS. 4 and 5) of the tray 5.

The guide grooves 5*a* on both side edges of the tray 5 engaged with the pins 6*b* on the second end portion 6*f* of the links 6, 6 are formed as a long hole as illustrated in the drawings. The length of the guide groove 5*a* is set to approximately correspond to the distance of movement of the pin 6*b* (disposed on the second end portion 6*f* side) on the link 6 necessary for the tray 5 to move in swinging motion from either the sheet feed position (FIGS. 1 and 2) or the maintenance position (FIGS. 4 and 5) to the storage position (FIG. 6). That is, the long hole has a length corresponding to a larger one among movement distances of the pin 6*b*, respectively in a case where the tray is moved from the first position to the storage position and in a case where the tray is moved from the second position to the storage position.

As described, the link support portion 70 according to the present embodiment constitutes a portion of an inner wall surface 5*e* of the storage concave portion 5*c* disposed on the right door 201F in which the tray 5 is stored. However, if the link support portion can be supported either directly or indirectly on the apparatus body to support the tray movably by the link, the link support portion may be provided as a different member as the right door 201F, for example.

Next, operations under the above-described arrangement will be described. The tray 5 of the sheet feeding apparatus 10 for performing manual sheet feeding according to the present embodiment may be moved to and positioned at three positions described below. These three positions are the sheet feed position (FIGS. 1 and 2) for performing sheet feed operation, the maintenance position (FIGS. 4 and 5) for performing maintenance operation such as replacement of rollers, and the storage position (FIG. 6) for storing the tray within the apparatus body 201A when the sheet feed operation is not performed.

In the above-described arrangement, an operator, i.e., user or service engineer, can select one of two lock positions where the pin 6*a* of the link mechanism is locked to either one of the lock holes 7*a* and 7*b* which serve as first and second support parts. Thereby, the tray 5 is moved to and positioned at either the sheet feed position (FIGS. 1 and 2) or the maintenance position (FIGS. 4 and 5). Meanwhile, the tray 5 can be moved to the storage position (FIG. 6) regardless of whether the tray 5 is positioned at the sheet feed position (FIGS. 1 and 2) or the maintenance position (FIGS. 4 and 5). In this case, the tray 5 is moved to the storage position (FIG. 6) while the pin 6*b* of the link 6 (on the second end portion 6*f* side) moving along the guide groove 5*a* formed as a long hole having the above-described length.

The sheet feed position of the tray 5 for performing the sheet feed operation is a position where the tray 5 is opened from the right door 201F, as illustrated in FIG. 1. In the case of the sheet feed position, the pin 6*a* on the first end portion 6*d* of the link 6 is engaged to a first lock hole 7*a* on an upper side end portion of the hole 7. Further, the pin 6*b* on the second end portion 6*f* of the link 6 is locked to an end portion of the guide groove 5*a* close to the swing shaft 9 formed as a long hole on the side edge of the tray 5. Thus, the position (orientation) of the tray 5 is locked to the sheet feed position by the locked relationship of the respective portions.

In the sheet feed position of the tray 5, it is preferable that an engagement structure as descried below is formed between the link 6 and the first lock hole 7*a* (of the guide hole 7).

When performing a normal sheet feed operation, for example, the tray 5 is opened from the storage position and moved to the sheet feed position (FIGS. 1 and 2), where the tray is locked. In this case, an engagement structure of the link 6 and the lock hole 7*a* (of the guide hole 7) as described below may be preferred to prevent the tray 5 from moving easily from the sheet feed position (FIGS. 1 and 2).

FIG. 3A shows the position of the link 6 supporting the tray 5 and the load direction T in which the load of the tray 5 is applied on the lock hole 7*a* of the guide hole 7 in the sheet feed position (FIGS. 1 and 2). Further, FIG. 3B illustrates a shape of the guide hole 7 in the same state with the link 6 removed.

In this arrangement, a dimension of, i.e., a width of, a narrow portion 7*c* (denoted by the letter 'C' in the drawing), which is a portion communicated with a bent portion 7*f* of the L-shaped guide groove 7*e* (guide part) communicated with the lock hole 7*a*, is set somewhat narrower than a diameter, i.e., inner diameter, of the lock hole 7*a* formed approximately as a round hole. Thereby, a snap-fit structure is formed as a mechanism for locking the pin 6*a* at the lock hole 7*a*. According to such locking mechanism, the pin 6*a* on the first end portion 6*d* of the link 6 can be positioned and fixed by snap-fit engagement to the lock hole 7*a*, so that the link 6 and the lock hole 7*a* will not be separated by an external force of a normal level corresponding to the load of normal sheets. This arrangement enables to prevent problems such as the tray 5 being opened to the maintenance position by an external force of the normal level. It is noted that the narrow portion 7*c* is expected to exert an effect similar to the present embodiment not only when it is positioned next to the lock hole 7*a* but when it is arranged at least between the lock hole 7*a* and the bent portion 7*f*.

If the portion of the right door 201F where the hole is formed is made of resin, the dimension of portion C illustrated in FIG. 3B should preferably be approximately 5 to 10% smaller than the dimension of the engagement portion of the link 6, from the viewpoint of workability. Actually, when the diameter of the lock hole 7*a* to which the link 6 is engaged is approximately 6 mm, for example, the dimension of portion C should preferably be in the range of 5.4 to 5.7 mm.

Further, the guide hole 7 can adopt a shape where the lock holes 7*a* and 7*b* are formed as described above, and the area between the holes are communicated by a hole bent in an L-shape. The bent shape of the guide hole 7 enables to prevent the tray 5 from deviating from the sheet feed position. For example, the direction in which the link 6 transmits the load of the tray in the sheet feed position (T in FIGS. 3A and 3B) is set to differ from the direction in which the link 6 passes the snap-fit of the lock hole 7*a* (R in FIG. 3B). In other words, the guiding direction R along which the guide hole 7 guides the first end portion 6*d* when the first end portion 6*d* is moved from the lock hole 7*a* toward the bent portion 7*f* differs from a load direction T of the load applied to the lock hole 7*a* via the first end portion 6*d* when the tray 5 is at the sheet feed position. An angle θ between the guide direction R and the load direction T should preferably be equal to or greater than a right angle. That is, the angle θ [degrees] should preferably be set such that θ≥90. In other words, the present structure is arranged so that a direction in which the portion of the guide hole 7 communicating with the first lock hole 7*a* extends in the sheet feed position of the tray 5 has an angle of 90 degrees or greater with respect to the direction of load applied to the lock hole 7*a* via the pin 6*a* of the first end portion 6*d* of the link 6. According to this structure, the link 6 will not be disengaged from the lock hole 7*a* even when external force is applied to the tray 5 in the gravity direction at the sheet feed position.

The changing of the tray 5 from the sheet feed position (FIGS. 1 and 2) to the maintenance position (FIGS. 4 and 5) is performed by the operator such as the service engineer (or user) changing the lock position of the pin 6*a* on the first end portion 6*d* of the link 6 with respect to the guide hole 7 from the lock hole 7*a* to the lock hole 7*b*. A locus of movement of the link 6 caused by this operation is illustrated by an arrow (M) in FIG. 4. Especially when a snap-fit structure as described above and a bent shape of the guide hole 7 are adopted, the locus of movement (M) of the link 6 must be adjusted so that the snap-fit lock is unlocked and the pin 6*a* is moved to the communicated portion of the L-shaped hole. Although some experience may be required for this operation, such an operation method is preferable from the point of view of preventing erroneous operation, since the movement of the tray 5 to the maintenance position is normally performed by a service engineer (or a skilled user). Of course, the operation method for changing the position of the tray 5 from the sheet feed position (FIGS. 1 and 2) to the maintenance position (FIGS. 4 and 5) should preferably be illustrated in detail on a service or maintenance manual.

Next, the maintenance position (FIGS. 4 and 5) of the tray 5 for performing maintenance operations, such as roller replacement, will be described in further detail. As illustrated in FIGS. 4 and 5, the maintenance position of the tray 5 is a position where the tray 5 is opened at a greater opening angle than the sheet feed position.

In this maintenance position, the pin 6*a* on the first end portion 6*d* of the link 6 is engaged with the lock hole 7*b* on the lower end portion of the guide hole 7. Further, the pin 6*b* on the second end portion 6*f* side of the link 6 is locked to an end portion on the side close to the swing shaft 9 of the guide groove 5*a* provided on the side edge of the tray 5. Similar to the case of the sheet feed position, the guide direction along which the guide hole 7 guides the first end portion 6*d* when the first end portion 6*d* is moved from the lock hole 7*b* toward the direction of the bent portion 7*f* differs from the load direction of load applied to the lock hole 7*a* via the first end portion 6*d* when the tray 5 is at the maintenance position. Based on the relationship of the respective portions being locked, the tray 5 is positioned and fixed at the maintenance position where the orientation (position) of the tray 5 is opened at a greater opening angle than the sheet feed position.

As described, when the tray 5 is moved to the maintenance position (FIG. 5), the maintenance operations regarding the components of the sheet feed unit 10F, such as the pickup roller 1, the conveyance roller 2 and the separation roller 3, can be performed using the space on the upper outer side of the tray 5 without opening the right door 201F (or a front side door). For example, a work space for removing the separation roller 3 or the nip guide 8 from the tray 5 can be created by moving the tray 5 from the sheet feed position (FIG. 2) to the maintenance position (FIG. 5). Now, the nip guide 8 is arranged to cover a portion of the separation roller 3 from the viewpoint of the sheet conveyance direction Fd to guide the sheet P to the space between the conveyance roller 2 and the separation roller 3 reliably, as illustrated in FIG. 2. According to this arrangement, when the tray 5 is moved to the maintenance position, the detaching and attaching of the nip guide 8 is facilitated and the workability in maintenance operations such as roller replacement is improved.

Further, the tray 5 can be moved in swinging motion to the storage position illustrated in FIG. 6. That is, the tray 5 can be moved to the storage position illustrated in FIG. 6, and stored in an orientation where the tray is approximately flush with the outer circumference portion (portion of the right door 201F in the present embodiment) of the apparatus body 201A.

Therefore, the pin 6*b* on the second end portion 6*f* of the link 6 is designed to slide within the engagement portion, i.e., link support portion 50, of the tray 5. For example, the pin 6*b* on the second end portion 6*f* of the link 6 is engaged with the guide groove 5*a* provided on the side edge of the tray 5. The length of the guide groove 5*a* formed as a long hole is set so that the tray 5 reaches the storage position (FIG. 6) regardless of whether the pin 6*a* on the first end portion 6*d* of the link 6 is engaged with the lock hole 7*a* or the lock hole 7*b* of the guide hole 7. That is, regardless of whether the pin 6*a* on the first end portion 6*d* of the link 6 is engaged with the lock hole 7*a* or the lock hole 7*b* of the guide hole 7, the pin 6*b* on the second end portion 6*f* slidingly moves along the guide groove 5*a* until the tray 5 is moved to the storage position (FIG. 6).

According to this structure, the orientation of the tray 5 can be moved to the storage position (FIG. 6) regardless of whether the pin 6*a* on the first end portion 6*d* of the link 6 is engaged with the lock hole 7*a* or the lock hole 7*b* of the guide hole 7. Therefore, the possibility of damaging the link 6 or the tray 5 by the tray 5 being closed unexpectedly during maintenance and the like is minimized. However, after a service engineer moves the tray 5 to the maintenance position (FIGS. 4 and 5) and performs maintenance operations, and then moves the tray 5 to the storage position (FIG. 6), it is preferable that the tray 5 is returned to the sheet feed position (FIGS. 1 and 2) before the tray is moved to the storage position (FIG. 6).

In the above-described storage position (FIG. 6), it is necessary that the tray 5 is fixed in an orientation substantially flush with surrounding parts of the apparatus body 201A (in the present embodiment, a portion of the right door 201F). In order to realize this arrangement, a latch mechanism 5*b* is provided at the end portion of the tray 5, as illustrated in FIG. 4. The latch mechanism 5*b* is designed to fix the tray 5 to the storage position (FIG. 6) by being engaged with a latch receiving clasp and the like (not shown) arranged at a corresponding position on an inner edge of the right door 201F, for example. An arbitrary release operation method may be adopted to release the lock of the latch mechanism 5*b* and move the tray to the sheet feed position (FIGS. 1 and 2) or the maintenance position (FIGS. 4 and 5). For example, the latch mechanism 5*b* can be designed to release the engagement through a release operation, such as by operating a lever or a push button, for example.

Figure 7:
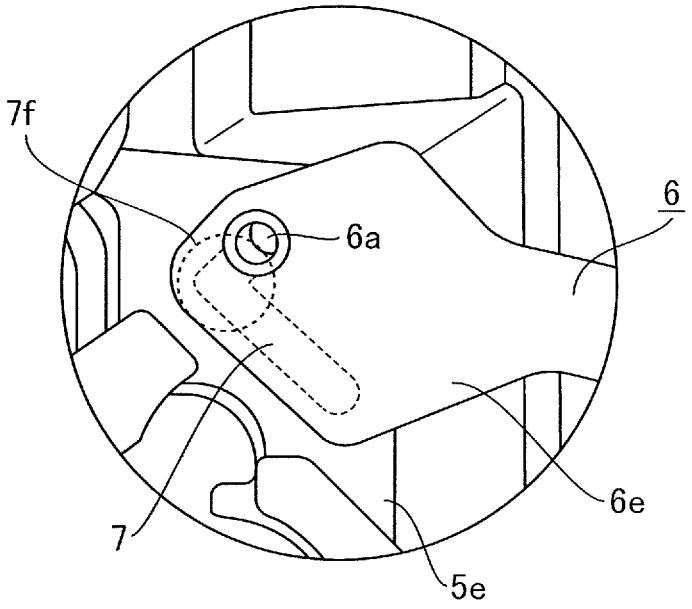
FIG. 7 is a perspective view of the sheet feeding apparatus according to the present embodiment, illustrating a different shape of the link.

The end portion of the link 6, especially the first end portion 6*d*, may be designed to cover and hide the L-shaped guide hole 7 so that the whole guide hole 7 will not be visible when the pin 6*a* is engaged with either the lock hole 7*a* or the lock hole 7*b* of the guide hole 7 or when the pin 6*a* is being moved through the communicated portion between the holes 7*a* and 7*b*. One possible example of the shape of the first end portion 6*d* on the link 6 is a cover portion 6*e* as illustrated in FIG. 7. For example, if the movement of the tray 5 to the maintenance position is treated as a concealed function from general users, it is preferred that the shape of the guide hole 7 which may suggest the possibility of moving the tray to the maintenance position is invisible. This configuration minimizes the chance of an unexpected operation of general users moving the tray 5 to a maintenance position, which is not necessary in general circumstances. In FIG. 7, the cover portion 6*e* is designed to cover the whole guide hole 7, but the design is not restricted to such example. For example, the cover portion 6*e* can be designed to at least cover the bent portion 7*f*.

As described, according to the present embodiment, even when a load caused by the weight of sheets or the external force from the user is applied to the swinging direction of the tray when the tray 5 is positioned at the sheet feed position or the maintenance position, the link support portion holds the tray 5 at the lock position against the load, without yielding to the load. Now, the tray might take a position opened wider than the normal sheet feed position by adopting an arrangement where the opening angle of the tray can be changed in multiple steps using an elastic member. In this configuration, however, the change of position is performed by applying an external force in the tray opening direction. Therefore, when an external force is applied unexpectedly in the gravity direction, the angle of the tray may be varied, and a sheet feed failure such as multiple feeding or delivery failure may be caused.

In contrast, according to the present embodiment, even when an external force operating in the swinging direction of the tray 5 is applied to the tray 5 at the sheet feed position or the maintenance position, the link support portion support and hold the tray 5 at the lock position against the load without yielding to the load. Therefore, the present embodiment provides a superior sheet feeding apparatus that hardly cause sheet feed failures such as multiple feeding or delivery failure. It is noted that such an advantage can be achieved by an arrangement capable of holding the tray 5 rigidly at the sheet feed position and the maintenance position. Therefore, it does not eliminate the possibility of utilizing an elastic member as a component of the link support portion and the like, with the aim to reduce the operation load of the user for example.

Furthermore, the present embodiment provides a sheet feeding apparatus capable of moving the tray 5 to a maintenance position preferable for performing maintenance operations without using a tool, and without removing any component for maintenance operation, so that the provided sheet feeding apparatus has superior maintainability and reduced chance of losing components. Even further, the present embodiment provides an image forming apparatus having a high productivity capable of performing maintenance operations of the sheet feed unit 10F disposed around the tray without having to open and close doors, and capable of performing maintenance operations without stopping printing jobs when a sheet feeding operation is performed from a sheet feed portion other than the manual sheet feed portion.

Other Embodiments

In the above description, the link support portion for the link 6 on the apparatus body for the link 6 is composed of the guide hole 7 having lock holes 7*a* and 7*b* as first and second support parts and the guide groove 7*e*, i.e., guide part, as a guide communicating the area between the lock holes via a bent path. Further, the support portion for the link 6 on the tray 5 is composed of the guide groove 5*a*. Correspondingly, the first and second end portions of the link 6 engaged with the support portions respectively include pins 6*a* and 6*b*. However, the recessed-and-projected relationship of the first and second support parts and the first and second end portions of the link 6 engaged respectively with the support portions of the link 6 on the tray 5 may be set opposite from the above-illustrated relationship. For example, the above-described guide holes 7 and the guide grooves 5*a* may be projected members, such as guide rails. In that case, the first and second end portions of the link 6 engaged with these support portions are preferably composed of members such as link claws or guide rollers.

Further, as long as the guiding direction of the guide part and the load direction by the tray weight differ from each other with respect to the first end portion of the link supported by the first support part, the bent shape of the guide part is not restricted to the illustrated example. For example, a portion of the guide groove 7*e* may be curved smoothly. In that case, the bent portion refers to a middle position in the guiding direction of the guide part of the bent or curved portion. Further, if there are a plurality of bent shapes formed to the guide part, such as a W-shaped guide groove, the area where the first end portion of the link initially passes when moving from the first support part to the second support part is referred to as the bent portion.

Further, the maintenance position of the tray according to the above embodiment is illustrated as a position where the supported surface of the sheet P is approximately horizontal (FIG. 5), but as long as the tray is opened with a wider opening angle than the sheet feed position, the maintenance position is not restricted to such position.

The sheet feeding apparatus according to the present embodiment may be applied advantageously to various image forming apparatuses adopting various image forming methods as sheet feeding apparatuses for performing manual sheet feeding, for example. In the above embodiment, an example of a separate roller arrangement has been illustrated where the sheet feed unit 10A is equipped with a separation roller 3, but the arrangement of the sheet feed unit is not restricted to such example. A pad separation arrangement may be adopted where the sheet is separated by a pad pressed onto the sheet feed roller, for example. Moreover, when it is assumed that the sheets are manually fed one by one by a user and the like, the sheet feed unit is not required to have a sheet separating function, and it may just have a mutually co-rotating sheet feed roller pair.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-163454, filed on Aug. 21, 2015, which is hereby incorporated by reference herein in its entirety.

What is claimed is:

1. A sheet feeding apparatus comprising:

an apparatus body;

a tray swingably supported on the apparatus body;

a sheet feed unit configured to feed a sheet supported on the tray;

a link comprising a first end portion and a second end portion, the second end portion being configured to engage with the tray;

a long hole, disposed on the tray, along which a pin that is provided on the second end portion of the link is guided;

a link support portion disposed in the apparatus body and configured to engage with the first end portion of the link, the link support portion comprising:

a first support part on which the first end portion is supported while the tray is positioned at a first position where the sheet supported on the tray is fed by the sheet feed unit;

a second support part on which the first end portion is supported while the tray is positioned at a second position where a swing angle of the tray is greater than the first position with respect to the apparatus body; and a guide part along which the first end portion of the link moves between the first support part and the second support part.

2. The sheet feeding apparatus according to claim 1, wherein the guide part has a bent part between the first support part and the second support part so that a guiding direction in which the first end portion is guided from the first support part toward the bent part differs from a load direction in which the first end portion of the link applies load on the first support part in a case where the tray is positioned at the first position.

3. The sheet feeding apparatus according to claim 2, wherein the link support portion comprises a narrow portion having a smaller inner width than that of the first support part and disposed between the first support part and the bent part.

4. The sheet feeding apparatus according to claim 2, wherein a difference between the guiding direction in which the first end portion is guided from the first support part toward the bent part, and the load direction in which the first end portion of the link applies load on the first support part in a case where the tray is positioned at the first position is 90 degrees or greater.

5. The sheet feeding apparatus according to claim 2, wherein the link comprises a cover portion covering the bent part in a state where the first end portion is supported on the first support part.

6. The sheet feeding apparatus according to claim 2, wherein a section of the guide part from the first support part to the bent part and a section of the guide part from the bent part to the second support part are respectively formed approximately linearly.

7. The sheet feeding apparatus according to claim 2, wherein the guide part is formed so that a guiding direction in which the first end portion is guided from the second support part toward the bent part differs from a load direction in which the first end portion of the link applies load on the second support part in a case where the tray is positioned at the second position.

8. The sheet feeding apparatus according to claim 1, wherein the link comprises a cover portion covering the link support portion in a state where the first end portion is supported on the first support part.

9. The sheet feeding apparatus according to claim 1, wherein the guide part is a guide groove where the first support part is disposed at one end and the second support part is disposed at another end.

10. The sheet feeding apparatus according to claim 9, wherein the link support portion is capable of locking the first end portion of the link at the first support part by snap-fit.

11. The sheet feeding apparatus according to claim 1, wherein the tray is swingable to a storage position where the tray is stored in the apparatus body.

12. The sheet feeding apparatus according to claim 11, wherein the apparatus body comprises a storage concave portion defining a space to store the tray at the storage position, and wherein the link support portion comprises a portion of an inner wall of the storage concave portion.

13. The sheet feeding apparatus according to claim 11, wherein the long hole has a length corresponding to a larger one among movement distances of the pin in a case where the tray is moved from the first position to the storage position and in a case where the tray is moved from the second position to the storage position.

14. The sheet feeding apparatus according to claim 1, wherein the sheet feed unit comprises a roller detachably attached to the apparatus body.

15. The sheet feeding apparatus according to claim 1, further comprising a guide member provided downstream of the tray in a sheet feeding direction of the sheet feed unit, the guide member being detachably attached to the apparatus body.

16. The sheet feeding apparatus according to claim 15, wherein the sheet feed unit comprises:

a feed roller configured to feed the sheet supported on the tray, a conveyance roller configured to convey the sheet received from the feed roller, and a separation roller in pressure contact with the conveyance roller, the separation roller being configured to separate the sheet conveyed by the conveyance roller, and wherein the guide member covers at least a portion of the separation roller viewed from a conveyance direction of the sheet by the feed roller.

17. The sheet feeding apparatus according to claim 1, wherein the second position is a maintenance position where the parts of the sheet feeding apparatus is replaced.

18. An image forming apparatus comprising:

the sheet feeding apparatus according to claim 1; and an image forming unit configured to form an image on a sheet fed by the sheet feeding apparatus.

19. A sheet feeding apparatus comprising:

an apparatus body;

a tray supported on the apparatus body;

a sheet feed unit configured to feed a sheet supported on the tray;

a link configured to support the tray;

a first engaging part disposed on one of the apparatus body and the tray and configured to engage with a first end portion of the link;

a second engaging part disposed on the one of the apparatus body and the tray and configured to engage with the first end portion of the link;

a first guide part disposed on the one of the apparatus body and the tray and configured to guide the first end portion of the link such that the first end portion can move between the first engaging part and the second engaging part; and a third engaging part disposed on the other of the apparatus body and the tray and configured to engage with a second end portion of the link;

a fourth engaging part disposed on the other of the apparatus body and the tray, disposed at a different position from the third engaging part, and configured to engage with the second end portion of the link; and a second guide part disposed on the other of the apparatus body and the tray and configured to guide the second end portion of the link such that the second end portion can move between the third engaging part and the fourth engaging part, wherein in a state where the tray is open with respect to the apparatus body, the link supports the tray positioned at a first position in a case where the first end portion is engaged with the first engaging part, and supports the tray positioned at a second position separate from the first position in a case where the first end portion is engaged with the second engaging part, wherein the second end portion is engaged with the third engaging part in a case where the link supports the tray positioned at the first position or the second position, and is engaged with the fourth engaging part in a state where the tray is closed with respect to the apparatus body, and wherein the sheet feed unit is configured to feed the sheet supported on the tray at least in a case where the tray is positioned at the first position.

20. The sheet feeding apparatus according to claim 19, wherein the first guide part has a bent part between the first engaging part and the second engaging part so that a guiding direction in which the first end portion is guided from the first engaging part toward the bent part differs from a load direction in which the first end portion of the link applies load on the first engaging part in a case where the tray is positioned at the first position.

21. The sheet feeding apparatus according to claim 19, wherein the second guide part has a long hole that is configured to guide a projection provided on the second end portion of the link such that the projection moves along the long hole.

22. The sheet feeding apparatus according to claim 19, wherein the tray is swingably supported by the apparatus body, and the second end portion of the link is guided by the second guide part while the tray swings between a closure position where the tray is closed and the first position.

* * * * *